United States Patent [19]

Howell

[11] 4,242,389

[45] Dec. 30, 1980

[54] CARPET WEB HAVING PATTERNED ADHESIVE SEGMENTS ON THE BACKING THEREOF AND METHOD OF MANUFACTURE OF THE SAME

[75] Inventor: Charles I. Howell, Rocky Face, Ga.

[73] Assignee: World Carpets, Inc., Dalton, Ga.

[21] Appl. No.: 28,753

[22] Filed: Apr. 10, 1979

[51] Int. Cl.[3] ..... B32B 3/02; B32B 33/00

[52] U.S. Cl. ..... 428/40; 156/299; 156/300; 156/301; 156/302; 428/41; 428/44; 428/47; 428/48; 428/49; 428/50; 428/78; 428/95; 428/195; 428/219

[58] Field of Search ..... 428/40, 41, 44, 47, 428/48, 49, 50, 62, 78, 82, 95, 194, 195, 219, 299, 300, 301, 302

[56] References Cited

U.S. PATENT DOCUMENTS

| | | | |
|---|---|---|---|
| 2,030,135 | 2/1936 | Carpenter | 428/40 |
| 2,042,692 | 6/1936 | Wurzburg | 428/40 |
| 3,014,829 | 12/1961 | Curtin | 428/40 |
| 3,862,874 | 1/1975 | Hopper | 428/47 |
| 4,143,496 | 3/1979 | Destito | 428/40 |

*Primary Examiner*—Marion McCamish

*Attorney, Agent, or Firm*—Beveridge, DeGrandi, Kline & Lunsford

[57] ABSTRACT

A flexible carpet web having a plurality of spaced apart pressure sensitive adhesive segments disposed in a patterned relationship on the backing thereof, and in which the same are preferably patterned according to certain given parameters involving the relation of the total area of the adhesive segments to the weight and/or the area of the carpet web, the spacing between adhesive segment centers as related to the area of the adhesive segments, and/or the spacing apart of the adhesive segments in relation to the configuration thereof; and a method of manufacture of a carpet web having adhesive segments applied to the backing thereof for facile installation thereof.

29 Claims, 3 Drawing Figures

CARPET WEB HAVING PATTERNED ADHESIVE SEGMENTS ON THE BACKING THEREOF AND METHOD OF MANUFACTURE OF THE SAME

BRIEF SUMMARY OF THE INVENTION

This invention relates to improvements in the construction and manufacture of flexible carpet to facilitate the installation thereof.

It has been an object of carpet manufacturers to provide a flexible broadloom carpet that could be easily and simply installed by the consumer and give a professionally installed appearance. Present methods of carpet installation are somewhat complex, involving securing the carpet to the floor with either glue, staples, carpet tape, nails, or mechanically stretching the carpet to tackless strips, dependent upon the particular installation situation.

Rolls of double-coated carpet tape (usually a paper or vinyl tape coated on both sides with a pressure sensitive adhesive) are available for do-it-yourself or professional carpet installation. These tapes are fairly expensive, and the consumer finds that his carpet installation costs rapidly escalate. Also, the do-it-yourself carpet installer has no expertise in where to place the double-coated tape, or how much to use. With or without double-coated tape, do-it-yourself carpet is difficult to install so that the result is a professional appearance. The end result is usually improperly installed carpet.

I recognize that others have previously attempted to provide flexible foam back carpet tiles having a partially or fully coated pressure sensitive adhesive back, usually involving one square foot sections of carpet. Such proved unsuccessful, due to foam delamination attributable to dragging furniture over the carpet tiles, or incomplete lamination to the floor of the carpet.

The inventive concept of this invention is the provision of flexible full width carpet web, having a plurality of spaced apart pressure sensitive adhesive segments disposed in a patterned relationship on the backing thereof in a manner for optimum carpet installation. Each adhesive segment is covered with release paper which extends beyond the adhesive segment for ease of removal.

An object of the invention is a carpet that may be removed from the floor and re-used at a new location by means of a delaminable elastomeric skincoat on the carpet foam backing, to which the adhesive segments are attached. When the carpet is removed from the floor for cleaning, relocation, etc., the elastomeric skincoat partially delaminates from the foam and remains on the floor with the adhesive segment. The skincoat and adhesive segment may then be easily removed from the floor.

A further object is the provision of a flexible carpet web having a plurality of spaced-apart pressure sensitive adhesive segments patterned on the backing thereof, according to certain parameters involving the relation of the total area of the adhesive segments to the weight of the carpet web, the spacing between adhesive segments as related to the area of the adhesive segments, and/or the spacing apart of the adhesive segments in relation to the configuration thereof.

A further object is the method of manufacture of a flexible carpet web having a plurality of spaced apart pressure sensitive adhesive segments disposed in a given patterned relationship on the backing thereof.

Other objects and advantages of the invention will become apparent from the following detailed description, taken in connection with the accompanying drawing, and in which drawing:

DETAILED DESCRIPTION

Figure 1:
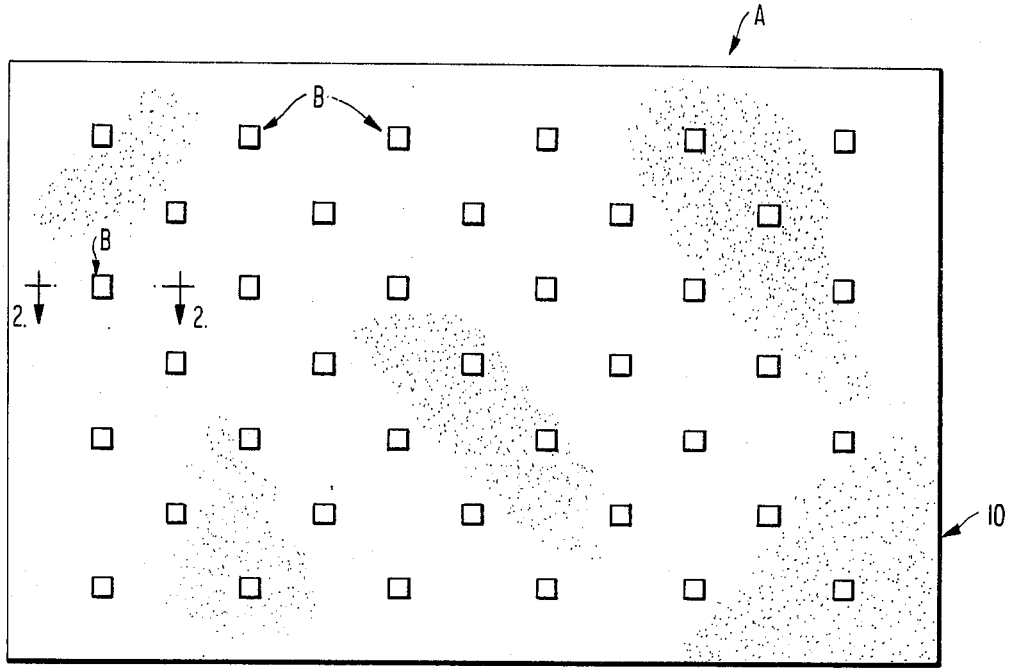
FIG. 1 is a plan view of a fragment of the back of a flexible carpet web having a plurality of spaced apart adhesive segments disposed thereon in a patterned relation according to the present invention.

In the drawing, wherein are shown preferred and modified forms of the invention, and wherein similar reference characters designate corresponding parts throughout the several views, the letter A may generally designate a flexible carpet web having spaced apart adhesive segments B disposed in a patterned relationship on the backing thereof.

Flexible carpet web A may be of any conventional type. As shown, the same preferably comprises what is referred to as a self-padded carpet web including a urethane foam backing 10, having a pile 11 provided on one side thereof and having a thin latex skincoat 13 on the under side thereof. I preferably select a carpet web backing of urethane foam since the same has good dimensional stability and thus, even in use, the physical dimensions thereof will remain fairly constant, as will also the spaced apart adhesive segments B thereof as patterned thereon by the manufacturer. Also, a carpet web backing of urethane foam is fairly light weight, facilitating transportation and installation of the carpet by the consumer. Further, a carpet web backing of urethane foam may be cleanly cut without appreciable fraying, which facilitates carpet installation.

By also preferably selecting a carpet web backing having a latex skincoat 13 on the under side thereof, and to which adhesive segments B are applied, the consumer will be able to remove the carpet from the floor without damage to urethane foam backing 10. That is, assuming a condition of strong adherence of adhesive segment B to the floor over which carpet web A is applied, then, on removal of carpet web A, the latex skincoat 13 will delaminate from backing 10, leaving backing 10 substantially undamaged, even though a small amount of backing 10 will be delaminated with the fragment of latex skincoat 13 which remains adhered to an adhesive segment B.

Figure 2:
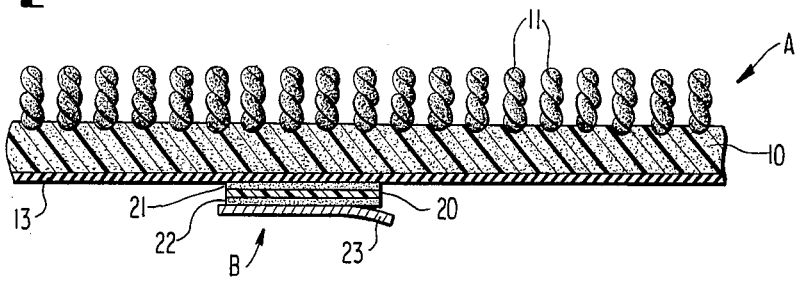
FIG. 2 is an enlarged sectional view taken substantially along the line 2—2 of FIG. 1.
Figure 3:
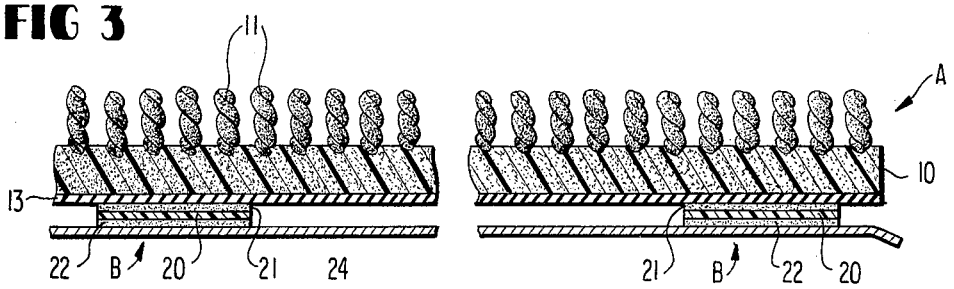
FIG. 3 is a sectional view similar to FIG. 2, showing a modified form of release liner for the spaced adhesive segments thereof.

Pressure sensitive adhesive segments B preferably comprise a vinyl tape 20 having a high tack rubber resin pressure sensitive adhesive 21 on one side thereof, and adhered to latex skincoat 13 and a high tack rubber resin pressure sensitive adhesive 22 on the other side thereof, over which is applied to easy release liner. As shown in FIG. 2, each adhesive segment B may be provided with an easy release liner 23. As shown in FIG. 3, a sheetlike one-piece easy release liner 24 may be provided over all or a given number of adhesive segments B.

In manufacture of a carpet web having a plurality of spaced apart adhesive segments on the backing thereof, a bank of commercially available pad applicators (not shown) are used to apply adhesive segments to the carpet backing according to a given pattern, using a roll of double coated carpet tape as cut into segments such as by the apparatus as shown in U.S. Pat. No. 3,472,724.

This invention does not contemplate that adhesive segments B be patterned on a flexible carpet web backing such as to be substantially continuous thereon. Preferably, the greater the carpet weight, the less the total area of the adhesive segments. That is, the total area of adhesive segments B is preferably inversely proportional to the weight of the carpet web. Also, the preferable pattern of adhesive segments B is such that the greater the area of each segment, the further they will be spaced apart. That is, the spacing between adhesive segment centers is proportional to the area thereof.

Adhesive segments B may be of any preferred configuration, square, rectangular, round, etc. They may also be of any desired size. However, for a given carpet web, all adhesive segments B thereof will usually be of substantially the same size and configuration.

By way of example, the adhesive segments B of the drawing have been shown as square. Use of square segments is, to some extent, a convenience in manufacture in use of different widths of double coated carpet tape rolls. That is, for a tape of one-inch width, to cut the same in lengths of one inch each, for a tape of a two-inch width, to cut the same into lengths of two inches, each, etc. Quite obviously, such tape rolls would also lend themselves to polygonal adhesive segments such as one inch wide and four inches long that would provide the same area as a two-inch square adhesive segment, but then the longitudinal spacing between segments would be greater than the transverse spacing therebetween, which could result in unequal tensile adhesiveness transversely of the carpet web in relation to that longitudinally of the carpet web. Since the manufacturer of the carpet web cannot usually anticipate in which direction the carpet will be laid in relation to the stress pattern of use, it is quite obviously preferable to make the carpet for equal tensile adhesiveness, longitudinally and transversely.

Preferred forms of a patterned relationship of adhesive segments of the same size and configuration, such as the square segments as shown in the drawing, are as follows:

For a carpet web of a weight from twenty to not more than forty ounces per square yard, to which are applied adhesive segments which each have an area less than one square inch (one-half squares by way of example), the preferable spacing between centers is from substantially two inches to substantially eighteen inches, and the ratio of the total area of such adhesive segments to the carpet web area is from substantially 1:16 to substantially 1:1296.

For a carpet web weight greater than thirty ounces per square yard, to which are applied adhesive segments which each have an area less than one square inch (one-half inch squares by way of example), the preferable spacing between centers is from substantially two inches to substantially twenty-four inches, and the ratio of the total area of such adhesive segments to the carpet web area is from substantially 1:16 to substantially 1:2304.

For a carpet web of a weight from twenty to not more than forty ounces per square yard, to which are applied adhesive segments which each have an area of one square inch (one-inch square segments by way of example), the preferable spacing between centers is from substantially six inches to substantially twelve inches, and the ratio of the total area of such adhesive segments to the carpet web area is from substantially 1:36 to substantially 1:144.

For a carpet web having a weight greater than thirty ounces per square yard, to which are applied adhesive segments which each have an area of one square inch, the preferable spacing between centers thereof is from substantially six inches to substantially twenty-four inches and the ratio of the total area of such adhesive segments to the carpet web area is from substantially 1:36 to substantially 1:576.

As the area of the adhesive segments increases, the relation thereof to the weight of the carpet web becomes less critical. As a general rule, in use of adhesive segments having an area of nine square inches (three-inch squares by way of example), the preferable spacing between centers thereof is from substantially twelve to substantially thirty-six inches, and the ratio of the total area of such adhesive segments to the carpet web area is from substantially 1:16 to substantially 1:144.

To put it another way, a preferable pattern of adhesive segments may be expressed as follows:

| Carpet Pile Weight (oz/sz yd) | Adhesive Segment Area (sq. inches) | Spacing Between Centers (inches) |
|---|---|---|
| 6-15 | 1-4 | 6-9 |
| 15-25 | 1-4 | 9-12 |
| 25-30 | 1-9 | 9-18 |
| 30-35+ | 1-9 | 9-36 |

Expressed by way of percentages, for adhesive segments having an area of one square inch or less, the lineal distance between centers of any given pair thereof is preferably at least substantially one hundred thirty-three percent of the area of each; for adhesive segments having an area greater than one square inch the lineal distance between centers of any given pair thereof is preferably from substantially one hundred percent to substantially twenty-four hundred percent of the area of each; and, for adhesive segments having an area greater than one square inch the spacing between the peripheries of any given pair of adhesive segments is preferably from substantially two hundred percent to substantially twenty-four hundred percent of the transverse diameter of each.

In installation of a carpet web including patterned adhesive segments on the backing thereof, as set forth herein, furniture and moveable objects are preferably removed from the area to be carpeted, the carpet is cut and trimmed to fit and placed in the area to be carpeted, then folded back onto itself to expose about one-half of the backing thereof, the easy release liner (either 23 or 24, as the case may be) removed from the adhesive segments B of the exposed carpet web A. The exposed portion of the carpet web A is then properly positioned on the floor and the adhesive segments thereof adhered to the floor such as by foot pressure. The other portion of the carpet web is then folded back onto that portion for which the adhesive segments have been activated, exposing the adhesive segments of such other portion, and the easy release liner (again, either 23 or 24) removed from the adhesive segments of the exposed carpet web backing. Such exposed portion is then properly positioned on the floor and the adhesive segments B thereof activated such as by foot pressure thereon. Thus, the entire carpet has been installed with facility and has been properly secured to the floor by adhesive segments B.

Of course, adhesive segments B may be in a form other than as tape segments, for instance, as a pressure sensitive adhesive as layered directly on the flexible carpet web backing.

Also, as in the case of a tape, one adhesive side thereof could have an adherence capability greater than that of the other, for instance, wherein the properties of adhesion of the adhesive adhered to the carpet web are greater than the properties of adhesion of the adhesive to be applied to the floor over which te carpet web is to be laid.

Further, although adhesive segments B have been shown in the drawing in a pattern of aligned rows, it is obvious that the same could be otherwise patterned, for instance, in a staggered relation within the pattern parameters as herein set forth.

Various changes may be made to the forms of the invention as herein shown and described without departing from the spirit of the invention or the scope of the following claims.

I claim:

1. A flexible carpet web having a plurality of spaced apart pressure sensitive adhesive segments disposed in a patterned relationship on the backing thereof, the spacing between said centers of said adhesive segments being a function of the area of said adhesive segments, in relation to the area and weight of said carpet web, and said adhesive segments being spaced and configured for providing substantially uniform tensile adhesiveness longitudinally and transversely throughout said carpet web.

2. A flexible carpet web as specified in claim 1 wherein said adhesive segments are of substantially the same configuration and area.

3. A flexible carpet web as specified in claim 2 wherein the lineal spacing between the peripheries of any given pair thereof is not substantially less than two hundred percent of the transverse diameter of each.

4. A flexible carpet web as specified in claim 2 wherein for said adhesive segments having an area greater than one square inch, the lineal distance between centers of any given pair thereof is from substantially one hundred percent to substantially twenty-four hundred percent of the area of each.

5. A flexible carpet web as specified in claim 2 wherein for said adhesive segments having an area less than and of one square inch, the lineal distance between centers thereof is at least substantially one hundred thirty-three percent of the area of each.

6. A flexible carpet web as specified in claim 2 wherein the lineal spacing between the peripheries of any given pair of said adhesive segments is from substantially two hundred percent to substantially twenty-four hundred percent of the transverse diameter of each.

7. A flexible carpet web as specified in claim 2 wherein for said adhesive segments having an area greater than one square inch, the lineal distance between centers of any given pair thereof is from substantially one hundred percent to substantially twenty-four hundred percent of the area of each and the lineal spacing between the peripheries of any given pair thereof is from substantially two hundred percent to substantially twenty-four hundred percent of the transverse diameter of each.

8. A flexible carpet web as specified in claims 2 or 3 wherein the ratio of the total area of said adhesive segments to the area of said carpet web is from substantially 1:16 to substantially 1:2304.

9. A flexible carpet web as specified in claims 2 or 3 wherein the total area of said adhesive segments is inversely proportional to the weight of said carpet web, the lineal spacing between centers of any given pair of said adhesive segments having an area of less than one square inch is at least substantially one hundred thirty-three percent of the area of each, for a carpet web weight of from substantially twenty ounces per square yard to not more than forty ounces per square yard the ratio of the total area of said adhesive segments to the area of said carpet web is from substantially 1:16 to substantially 1:1296, and, for a carpet web weight greater than thirty ounces per square yard, the total area of said adhesive segments to the area of said carpet web is from substantially 1:16 to substantially 1:2304.

10. A flexible carpet web as specified in claims 2 or 3 wherein the total area of said adhesive segments is inversely proportional to the weight of said carpet web, the lineal spacing between centers of any given pair of said adhesive segments having an area of one square inch is at least substantially one hundred thirty-three percent of the area of each, for a carpet web weight of from substantially twenty ounces per square yard to not more than forty ounces per square yard the ratio of the total area of said adhesive segments to the area of said carpet web is from substantially 1:36 to substantially 1:144, and, for a carpet web weight greater than thirty ounces per square yard, the ratio of the total area of said adhesive segments to the area of said carpet web is from substantially 1:36 to substantially 1:576.

11. A flexible carpet web as specified in claims 2 or 3 wherein the total area of said adhesive segments is inversely proportional to the weight of said carpet web, the lineal spacing between centers of any given pair of said adhesive segments having an area greater than one square inch is from substantially one hundred percent to substantially twenty-four hundred percent of the area of each, for a carpet web weight of from substantially twenty ounces per square yard to not more than forty ounces per square yard the ratio of the total area of said adhesive segments to the area of said carpet web is from substantially 1:16 to substantially 1:444, and, for a carpet web weight greater than thirty ounces per square yard, the ratio of the total area of said adhesive segments to the area of said carpet web is from substantially 1:16 to substantially 1:576.

12. A flexible carpet web as specified in claims 1, 2, 3, 4, 5, or 6, wherein said adhesive segments comprise a tape having high tack pressure sensitive adhesive on each side thereof, one side of which is adhered to said carpet web and the other side of which is provided with an easy release liner, removal of which exposes the pressure sensitive adhesive on that side of the tape for adherence to the surface over which said carpet web is to be applied.

13. A flexible carpet web as specified in claim 12 wherein the properties of adhesion of the adhesive adhered to said carpet are greater than the properties of adhesion of the adhesive of the other side of said tape.

14. A flexible carpet web as specified in claims 1, 2, 3, 4, 5, or 6, wherein said adhesive segments comprise an adhesive layer adhered on one side thereof to said carpet web and is adhesively pressure sensitive on the other side thereof, said other side thereof being provided with an easy release liner removal of which exposes the pressure sensitive adhesive thereof for adherence to the surface over which said carpet web is to be applied.

15. The method of carpet manufacture on a commercial scale of full width carpet web which comprises the patterned placement of a plurality of spaced apart pressure sensitive segments on the backing of a flexible full width carpet with the spacing between the centers of the adhesive segments being a function of the area of the adhesive segments, in relation to the area and weight of the carpet web, the configuration thereof being such as to provide substantially uniform tensile adhesiveness longitudinally and transversely throughout said carpet web, and in juxtaposition to adhere to the surface over which the carpet web is to be applied.

16. The method of carpet manufacture as specified in claim 15 wherein the adhesive segments are formed to be of substantially the same configuration and area.

17. The method of carpet manufacture as specified in claim 16 wherein the adhesive segments are patterned on the carpet web with the lineal spacing between the peripheries of any given pair of adhesive segments not substantially less than two hundred percent of the transverse diameter of each.

18. The method of carpet manufacture as specified in claim 16 wherein the adhesive segments are formed to have an area greater than one square inch and are patterned with the lineal distance between centers of any given pair thereof being from substantially one hundred percent to substantially twenty-four hundred percent of the area of each.

19. The method of carpet manufacture as specified in claim 16 wherein the adhesive segments are formed to have an area less than one square inch and are patterned with the lineal distance between centers thereof at least substantially one hundred thirty-three percent of the area of each.

20. The method of carpet manufacture as specified in claim 16 wherein the adhesive segments are formed to have an area of one square inch and are patterned with the lineal distance between centers thereof at least substantially one hundred thirty-three percent of the area of each.

21. The method of carpet manufacture as specified in claim 16 wherein the adhesive segments are patterned with the lineal spacing between the peripheries of any given pair of adhesive segments being from substantially two hundred percent to substantially twenty-four hundred percent of the transverse diameter of each.

22. The method of carpet manufacture as specified in claim 16 wherein the adhesive segments have an area greater than one square inch and are patterned with the lineal distance between centers of any given pair thereof being from substantially one hundred percent to substantially twenty-four hundred percent of the area of each, and with the lineal spacing between the peripheries of any given pair thereof being from substantially two hundred percent to substantially twenty-four hundred percent of the transverse diameter of each.

23. The method of carpet manufacture as specified in claims 16 or 17 wherein the ratio of the total area of the adhesive segments to the area of the carpet web is from substantially 1:16 to substantially 1:2304.

24. The method of carpet manufacture as specified in claims 16 or 17 wherein the total area of the adhesive segments is inversely proportional to the weight of the carpet web, the adhesive segments have an area less than one square inch and are configured and patterned with the lineal spacing between centers of any given pair of adhesive segments being at least substantially one hundred thirty-three percent of the area of each, for a carpet web of from substantially twenty ounces per square yard to not more than forty ounces per square yard of the total area of adhesive segments to the area of the carpet web being from substantially 1:16 to substantially 1:1296; and, for a carpet web weight greater than thirty ounces per square yard, the ratio of the total area of the adhesive segments to the area of the carpet web being from substantially 1:16 to substantially 1:2304.

25. The method of carpet manufacture as specified in claims 16 or 17 wherein the total area of the adhesive segments is inversely proportional to the weight of the carpet web, the adhesive segments have an area of one square inch and are configured and patterned with the lineal spacing between centers of any given pair of adhesive being at least substantially one hundred thirty-three percent of the area of each, for a carpet web of from substantially twenty ounces per square yard to not more than forty ounces per square yard the ratio of the total area of adhesive segments to the area of the carpet web being from substantially 1:36 to substantially 1:144; and, for a carpet web weight greater than thirty ounces per square yard, the ratio of the total area of the adhesive segments to the area of the carpet web being from substantially 1:36 to substantially 1:576.

26. The method of carpet manufacture as specified in claims 16 or 17 wherein the total area of the adhesive segments is inversely proportional to the weight of the carpet web, the adhesive segments have an area greater than one square inch and are configured and patterned with the spacing between centers of any given pair of adhesive segments being from substantially one hundred percent to substantially twenty-four hundred percent of the area of each, for a carpet web weight of from substantially twenty ounces per square yard to not more than forty ounces per square yard the ratio of the total area of adhesive segments to the area of the carpet web being from substantially 1:16 to substantially 1:144; and, for a carpet web weight greater than thirty ounces per square yard, the ratio of the total area of the adhesive segments to the area of the carpet web being from substantially 1:16 to substantially 1:576.

27. The method of carpet manufacture as specified in claims 15, 16, 17, 18, 19, 20, 21, or 22 wherein the adhesive segments are formed of a tape having a high tack pressure sensitive adhesive on each side thereof, one side of each being adhered to the carpet web and the other side thereof being provided with an easy release liner.

28. The method of carpet manufacture as specified in claim 27 wherein the adhesive segments formed with the properties of the adhesive segments adhered to the carpet are greater than the adhesive properties of adhesion of the adhesive of the other side of the tape.

29. The method of carpet manufacture as specified in claims 15, 16, 17, 18, 19, 20, 21, or 22 wherein the adhesive segments comprise an adhesive layer adhered on one side thereof to the carpet web and is adhesively pressure sensitive on the other side thereof, such other side thereof being provided with an easy release liner.

* * * * *